United States Patent [19]

Cochran

[11] Patent Number: 5,048,611

[45] Date of Patent: Sep. 17, 1991

[54] PRESSURE OPERATED CIRCULATION VALVE

[75] Inventor: Chudleigh B. Cochran, Houston, Tex.

[73] Assignee: Lindsey Completion Systems, Inc., Midland, Tex.

[21] Appl. No.: 533,028

[22] Filed: Jun. 4, 1990

[51] Int. Cl.[5] ..... E21B 34/10

[52] U.S. Cl. ..... 166/374; 166/319; 166/321; 166/386

[58] Field of Search ..... 166/374, 383, 381, 386, 166/318, 319, 321, 323, 332

[56] References Cited

U.S. PATENT DOCUMENTS

| | | | |
|---|---|---|---|
| 3,306,365 | 2/1967 | Kammerer, Jr. | 166/318 |
| 3,789,926 | 2/1974 | Henley et al. | 166/318 |
| 3,791,449 | 2/1974 | Cochran | 166/312 |
| 3,799,268 | 3/1974 | Cochran | 166/313 |
| 3,882,936 | 5/1975 | Cochran | 166/319 |
| 4,429,747 | 2/1984 | Williamson, Jr. | 166/321 |
| 4,434,854 | 3/1984 | Vann et al. | 166/319 |
| 4,574,894 | 3/1986 | Jadwin | 166/319 |
| 4,576,233 | 3/1986 | George | 166/299 |
| 4,880,058 | 11/1989 | Lindsey et al. | 166/323 |

*Primary Examiner*—Bruce M. Kisliuk

[57] ABSTRACT

A circulating valve for use in oil field operations which is pressure operated without use of a wireline tool. The valve has a sleeve assembly with telescopically joined sleeve members normally closing off a circulation port in a mandrel. A pressure differential is utilized to shift the joined sleeve members to an unjoined condition opening the circulation ports. A second pressure differential is utilized to rejoin the sleeve members and close off the circulation ports. The sleeve members are independently shear pinned to the mandrel.

6 Claims, 4 Drawing Sheets

PRESSURE OPERATED CIRCULATION VALVE

FIELD OF THE INVENTION

This invention relates to methods and apparatus for circulation of drilling fluid (mud) in respect to a well bore, and more particularly, to a pressure operated circulating system for operating a circulating valve in a string of tubing in single or multiple completions of a well.

IDENTIFICATION OF PRIOR ART

Prior art patents known to the applicant are as follows.

U.S. Pat. No. 3,799,268 issued to C.B. Cochran on Mar. 26, 1974 (Class 166/313).

U.S. Pat. No. 3,791,449 issued to C.B. Cochran on Feb. 12, 1974 (Class 166/312).

U.S. Pat. No. 3,882,936 issued to C.B. Cochran.

Other patents which relate to circulating valves and pressure differential operated valves are as follows:

U.S. Pat. No. 4,113,012 issued to Evans et al (Class 166/264).

U.S. Pat. No. 4,576,233 issued to George (Class 166/297).

U.S. Pat. No. 3,970,147 issued to Jessup et al (Class 166/250).

U.S. Pat. No. 4,880,058 issued to Lindsey et al (Class 166/289).

BACKGROUND OF THE INVENTION

In multiple completion wells, a cased borehole traverses one or more vertically spaced oil production zones or strata in the earth strata. The borehole is lined and cemented in place with a casing and two or more of the vertically spaced strata are perforated for completion. The production from each of the strata is independently conveyed to the earth's surface by separate strings of tubing where the respective strings of tubing respectively extend to each of the producing strata. The producing strata are separated from one another by packer means. Thus at the very minimum there is a "long" string of tubing which extends through an upper packer located above an upper oil producing zone and extends through a lower packer which is located between the upper producing zone and the lower producing zone. The long string of tubing thus provides in independent flow conduit from the lower production zone through the upper production zone to the earth's surface. A "short" string of tubing extends from the earth's surface through the upper packer and opens to the upper production zone so that hydrocarbons are independently produced from the upper production zone to the earth's surface.

During the installation of the packers and strings of tubing and prior to production, the well casing is commonly filled with a weighted well control liquid commonly called "mud" which provides a hydrostatic pressure greater than the pressure of the fluids in the formations. Thus, the long and the short strings of tubing and the packers are installed with the existence of mud in the casing and the mud enters into the bores of the strings of tubing. The upper packer in a dual flow completion system ordinarily accommodates the two strings of tubing and the lower packer accommodates a single string of tubing. It is necessary for production to reverse out or remove the mud from a string of tubing. While there are various ways to do this, it is common to use a circulation valve in the string of tubing. The circulation valve is normally closed and is opened by a wire line tool so that fluid pressure in the annulus about a string of tubing can be used to reverse out the mud in a string of tubing.

There are a variety of systems used for controlling various pressure and gas conditions existent in the upper and lower production zones. Irrespective of the system in dual completions and in single completions as well, it is necessary to reverse out or circulate out the mud in the casing and in the string of tubing to the earth's surface. Usually the mud is replaced with a lighter weight liquid.

In U.S. Pat. No. 3,791,449, a system is shown where the long string of tubing has a pressure operated sleeve extension at its lower end. Thus when the upper packer is in position above the upper strata, the sleeve extension at the lower end of the long string of tubing remains open above the upper packer so that liquid can be circulated from the long string through the casing and to the earth's surface via the short string of tubing. Upon completion of the circulation operation, the extension sleeve on the long string of tubing is actuated to move downwardly into sealing engagement in a bore in the lower packer to complete the hookup. The extension sleeve in the long string of tubing is operated by dropping a ball and moving the extension sleeve under pressure to an extended position where it is locked in place by a one way clutch member in the lower packer. The ball is removable by pressure to discharge to the bottom of the well.

In U.S. Pat. Nos. 3,882,936 and 3,799,268, a circulating valve is located in a long string of tubing above the lower packer while the long string is connected to the lower packer. The circulating valve includes interconnected sleeves on a tubular body member where a circulating port is closed by the sleeves and the other sleeve is pressure balanced by pressure ports opening to equal and opposite effective pressure areas. When the long string is sealed in the sealing position in the lower packer member, an increase of pressure in the tubing string causes pressure in the circulating ports to disengage one of the sleeves from the other sleeve and the circulating ports are opened to the casing so that liquid can be circulated from the interior of the long string of tubing through the short string of tubing. When it is desired to close the circulating ports after circulation operation has been completed, a ball member is dropped into the string of tubing to separate the pressure ports providing the pressure balance on the other sleeve so that a pressure in the string of tubing above the scaling ball will cause the other sleeve member to slide axially and join with the one sleeve member to close the circulating ports.

In some dual well completions, it is customary to utilize wire line actuated circulating valves which require the time and use of a wireline crew and wireline tools. In many instances, well operators do not wish to utilize circulating valves requiring wireline operations. There is a need for pressure operated circulating valves particularly for dual flow completions.

Dual well completions, as discussed involve a control fluid (mud) in the casing to control the well pressure of the production zones. With upper and lower production zones, either zone may be higher in pressure. There are many instances where the differences in pressure in the production zones create a circulation problem for use of either the long string or short string. Thus, a circulation valve may be used in both long and short strings. Also, while dual production has been discussed it is common to use circulation valves in a single string.

SUMMARY OF THE PRESENT INVENTION

The present invention is embodied in a pressure operated downhole circulating valve for oil field use. The circulating valve can be operated by a pressure differential between the interior of the valve and the exterior of the valve.

In one form of the invention the valve is operated by a pressure differential in the interior of the valve which is greater than the pressure on the exterior of the valve. The valve includes sleeve assembly which has independent sleeve members which are selectively slidably mounted on a mandrel assembly for selective movement between longitudinally spaced shoulders on the mandrel assembly. Shear pins respectively connect the sleeve members to the mandrel assembly. A circulation port in the mandrel assembly is closed off by the sleeve members in one position of the sleeve members on the mandrel assembly. A first ball member is utilized to develop pressure differential across one of the sleeve members so that one of the shear pins is released and the sleeve members from one another to open the circulation port. To close the circulation port, a second ball member is utilized to develop a pressure differential across the other sleeve member so that the other shear pin is released and the sleeve members are rejoined to close off the circulation port. A one-way locking mechanism holds the sleeve members in a closed rejoined position where the circulation port is closed.

In another form of the invention, the valve is operated by a pressure differential in the annulus exterior to a circulating valve. The valve includes a sleeve assembly which has independent sleeve members which are selectively slidably mounted on a mandrel assembly for selective movement between longitudinally spaced shoulders on the mandrel assembly. Shear pins respectively connect the sleeve members to the mandrel assembly. A circulation port in the mandrel assembly is closed off by the sleeve members in one position of the sleeve members in one position of the sleeve members on the mandrel assembly. A pressure differential across one of the sleeve members enables shearing of a shear pin and relative movement of the sleeve members to open a circulation port in the mandrel assembly. To close the circulation port, the bore of the one sleeve member is closet off so that pressure within the tubing string produces a pressure differential across the other sleeve member to shift the other sleeve member into a rejoined condition with the one sleeve member and close off the circulation port. A latch device locks the other sleeve in the rejoined condition where the circulation port is closed off.

The circulation valve can be utilized in both single and multiple completions and avoids the use of a wireline shifting device.

DESCRIPTION OF THE PRESENT INVENTION

Figure 1:
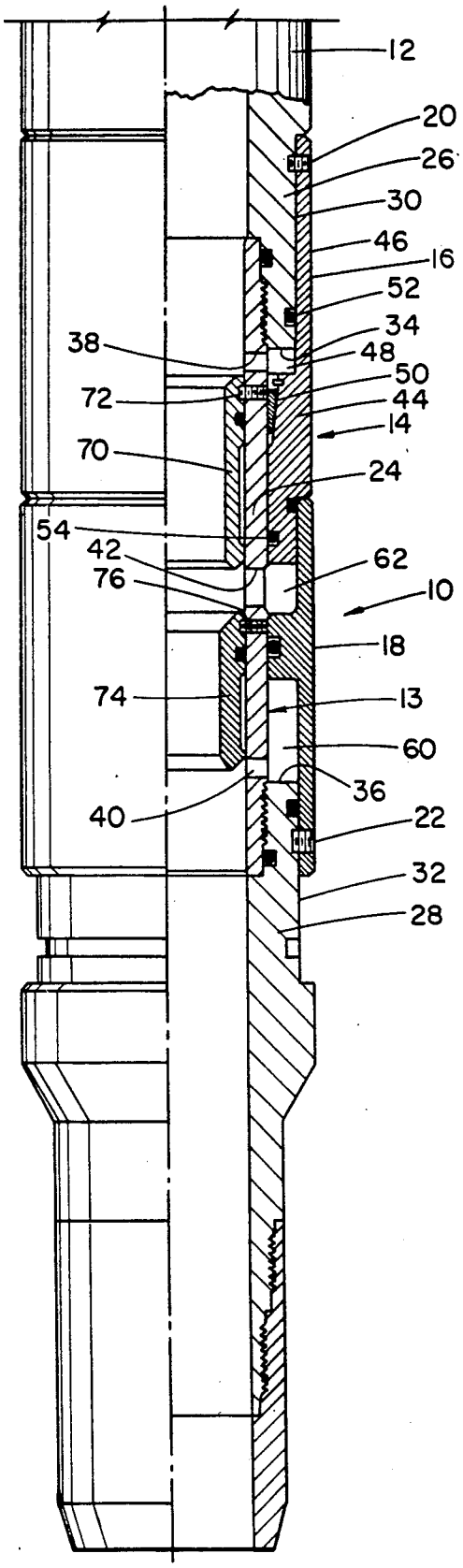
FIG. 1 is a view in partial longitudinal cross section of an internally pressure operated circulation valve in a closed position prior to circulation.

Referring now to FIG. 1, a tubing pressure circulation valve 10 is illustrated. The circulation valve is typically disposed in a string of tubing 12 and includes a tubular inner mandrel assembly 13 and an external or outer tubular sleeve valve assembly 14. The sleeve valve assembly 14 includes an upper tubular sleeve member 16 and a lower tubular sleeve member 18 which are slidable mounted on the mandrel assembly 13 and each sleeve member is releasably connected to the mandrel assembly in a "going-in" condition by a separate shear pin 20 and 22.

As shown in the "going-in" position in FIG. 1, the tubular mandrel assembly 13 has a tubular central mandrel member 24 threadedly coupled at its upper end to an upper head member 26 and threadedly coupled at its lower end to a lower head member 28. The respective upper and lower head members 26,28 may be identically formed and respectively have annular recessed portions 30,32. The interconnection of the upper head member 26 with the tubular mandrel 24 defines a downwardly facing shoulder 34 and interconnection of the lower head member 28 with the tubular mandrel 24 forms an upwardly facing shoulder 36. The mandrel 24 has an upper pressure port 38 adjacent to the downwardly facing shoulder 34 and has a lower pressure port 40 adjacent to the upwardly facing shoulder 36. Intermediate of the upper and lower pressure ports 38,40 is a centrally located circulation port 42. The upper sleeve member 16 has a body portion 44 disposed on the mandrel 24 and has an upwardly extending tubular portion 46. In the position shown, the tubular portion 46 extends over the annular recessed portion 30 on the upper head member 26 and abuts the end surface of the recessed portion 30. In the position shown, an annular space 48 is defined between the lower shoulder 34 and an inner, upwardly facing surface of the body portion 44 of the upper sleeve member. The shear pin 20 releasably connects the upper sleeve member 16 to the upper head member 26 in the position shown.

In the body portion 44 of the upper sleeve member 16 is a frusto-conical recess which receives an annular split ring locking member 50 with a tapered frusto-conical outer surface and inner cylindrical surface with gripping serrations. The locking ring member 50 provides a one way locking action so that the upper sleeve member 16 can be moved downwardly but the split ring member 50 will engage the surface of the mandrel member and the frusto-conical surface to prevent a return upward movement. The split ring member 50 is loosely contained in the conical recess so that the sliding and the locking action is permitted.

To provide a pressure responsive system, O-ring seals 52,54 are located on the upper head member 16 and on the mandrel member 24 so that the annular chamber 48 is, in fact, a pressure chamber with an effective pressure differential area defined between the O-ring seals 52,54. The annular pressure chamber 48 formed between the upper head member, the mandrel and the body portion of the sleeve opens to the interior bore of the mandrel by virtue of the port 38.

The lower sleeve member 18 has a central body portion which is connected to an upper tubular sleeve portion and to a lower tubular sleeve portion. The lower sleeve portion is releasably connected by the shear pin 22 to the lower head member 28 and defines a lower, annular pressure chamber 60 with the mandrel 24 and the lower head member 28. The lower pressure chamber 60 is accessed to the interior of the mandrel by the port 40 located in the mandrel just above the upwardly facing shoulder 36 of the lower head member 28. The upper sleeve portion is sealingly received on a recessed portion of the upper sleeve member 16. The circulation port 42 in the mandrel 24 is accessed to a circulation chamber 62 formed in an annular space between the mandrel 24 and the upper and lower sleeve members 16,18. In the position of the elements shown in FIG. 1, the lower sleeve member 18 has equal effective pressure areas which are accessed to the circulation port 42 and to the lower pressure port 40 so that pressure within the bore of the string of tubing ordinarily does not affect or act to move or release the lower sleeve member 18 by shearing the shear pin 22. Thus, while going-in the casing pressure surges cannot actuate the pressure balanced sleeve member 18.

The effective pressure areas of the upper sleeve member accessed by the upper pressure port 34 and the circulation port 42 are equal so that the fluid pressure within the tubing ordinarily will not adversely affect or act to move the the upper sleeve member 16.

Slidably disposed in the mandrel 24 at a location between the upper pressure port 38 and the circulating port 42 is a tubular first valve seat member 70( which is releasably connected by shear pin 72 to the mandrel 24. Slidably disposed in the bore of the mandrel 24 between the circulation port 42 and the lower pressure port 40 is a tubular second tubular valve seat member 74 which is releasably connected by a shear pin 76 to the mandrel 24. The first and second valve seat members 70 and 74 are respectively adapted to receive sealing balls where the second valve seat member 74 is sized to receive a smaller diameter ball member which can pass through a larger bore in the upper valve seal member 54.

Figure 2:
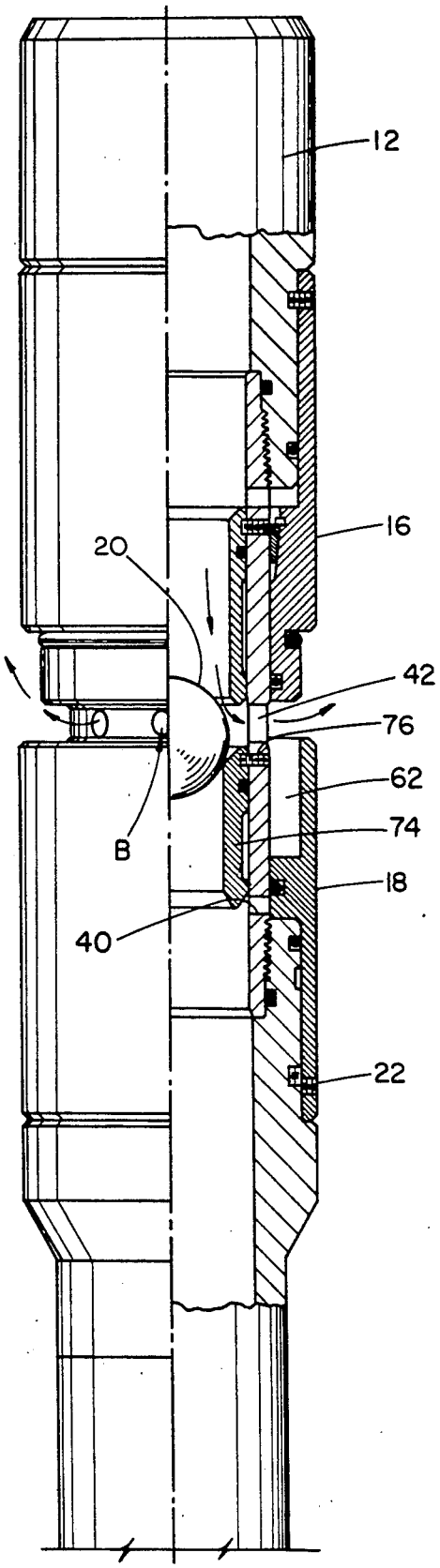
FIG. 2 is a view similar to FIG. 1 but illustrating the valve in an open condition for circulation.

To operate the valve, a first sealing ball 80 (see FIG. 2) is pumped through the string of tubing 12 to seat upon the lower valve seat member 74 thereby closing off the bore of the string of tubing and permitting pressure to be applied to the valve seat member 74. The resulting pressure is also applied through the circulating valve port 42 to the annular circulation chamber 62 between the upper and lower sleeve members 16 and 18. The pressure in the chamber 62 is increased to be greater than the pressure in the chamber 60 in the lower sleeve member 18. As a consequence, the shear pin 22 will be sheared when its shear strength is exceeded and the lower sleeve member 18 will be displaced and move longitudinally or axially to a lowermost position on the lower head member 28 as shown in FIG. 2. In the lowermost position of the lower sleeve member 18 on the lower head member 28, the circulating port 42 is open to the exterior of the sleeve members 16,18 to permit liquid internally of the string of tubing 12 to be circulated to the annulus externally of the string of tubing. By pumping liquid through the string of tubing, liquid in the annulus between the tubing and a casing can be circulated or returned to the earth's surface and be replaced with production control liquid in the string of tubing.

Figure 3:
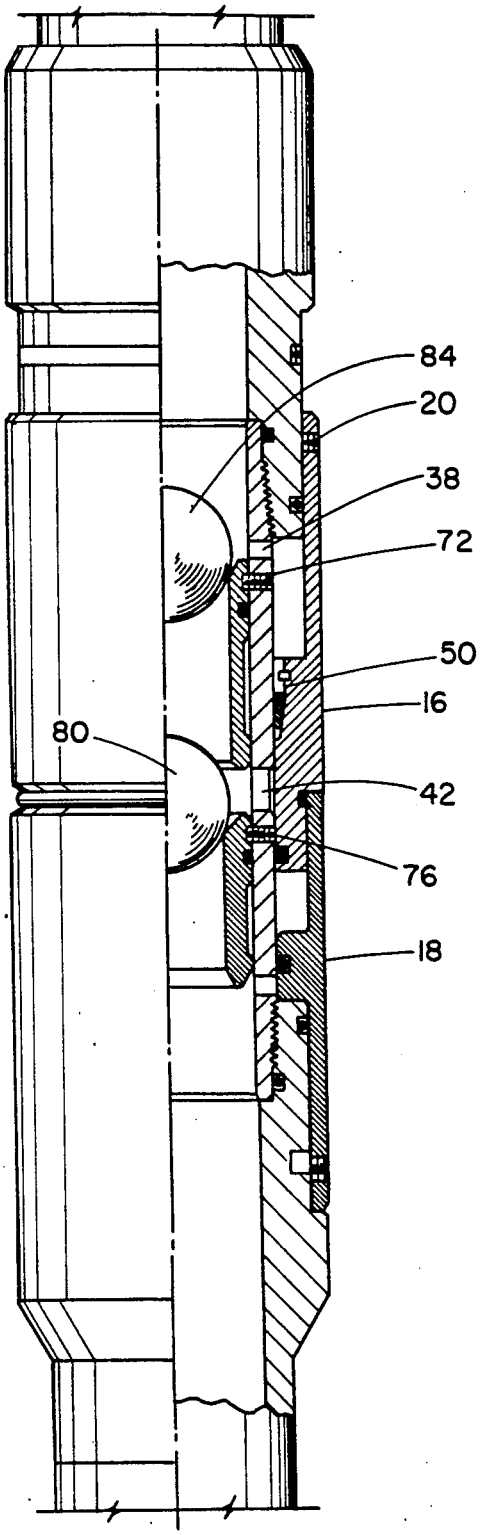
FIG. 3 is a view similar to FIG. 2 but illustrating the valve in a closed condition following circulation.

When the circulation operation has been completed, the circulating valve is closed by dropping a larger diameter sealing ball 84 through the string of tubing which seats in the upper seal ring member 70. (See FIG. 3). The ball 84 closes off the bore in the string of tubing from the circulation port 42 and permits liquid in the string of tubing to access the upper pressure port 38. The pressure on the upper sleeve member 16 then can be increased to a point where the shear pin 20 shears and the upper sleeve member 16 shifts downwardly to the position shown in FIG. 3. When the upper sleeve member 16 shifts downwardly, the circulating port 42 is again closed off by the reconnection of the sleeve members 16 and 18 and the upper and lower sleeve members 16 and 18 are sealingly reconnected with respect to the sealing means. The one way ratchet ring member 50 presents a return of the upper sleeve member 16 so the circulating valve is effectively cut off or closed.

Figure 4:
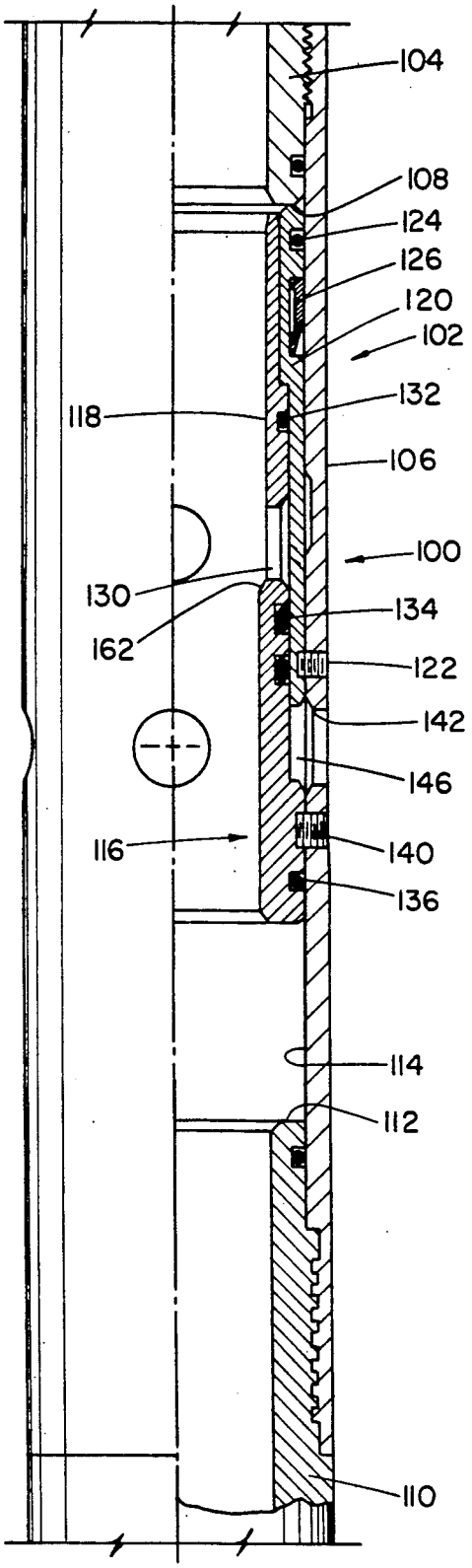
FIG. 4 is a view in partial longitudinal cross section of an external pressure operated circulation valve in a closed condition prior to circulation.
Figure 5:
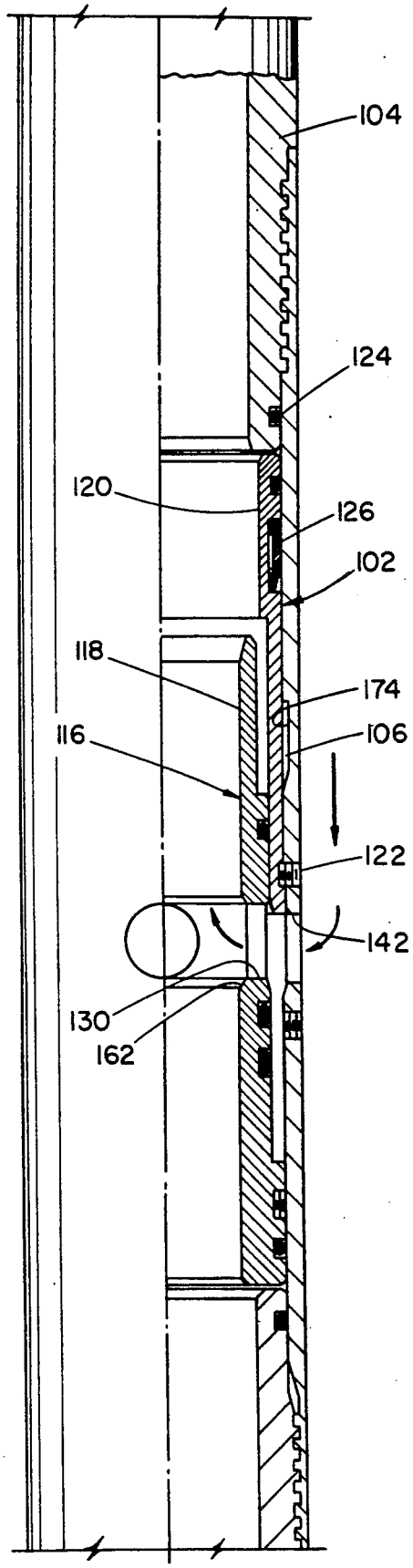
FIG. 5 is a view similar to FIG. 4 but illustrating the valve in an open condition for circulation.
Figure 6:
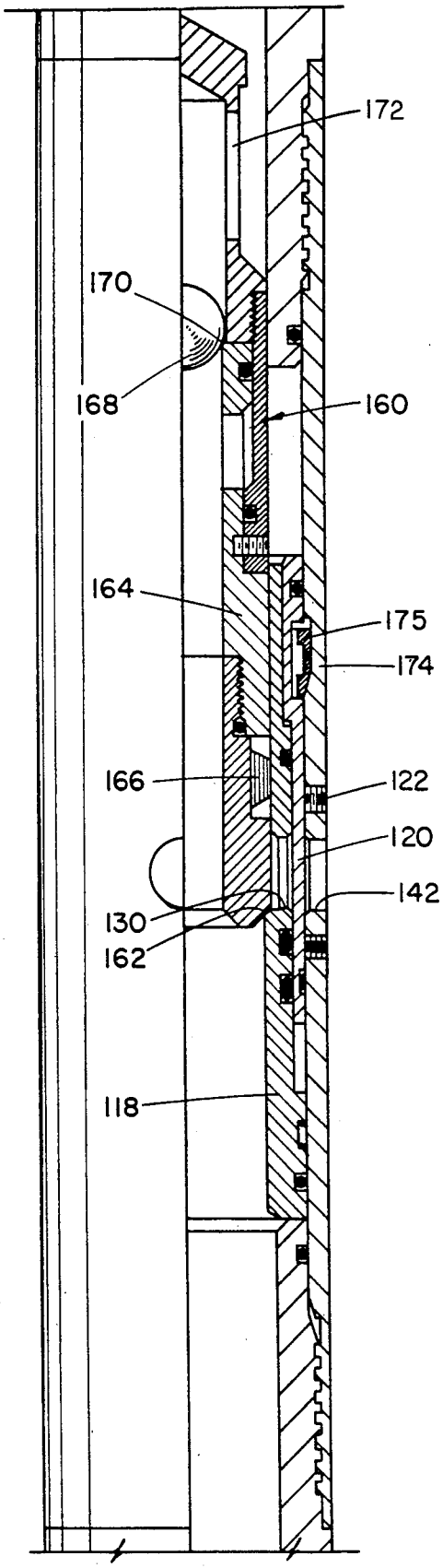
FIG. 6 is a view similar to FIG. 5 but illustrating the valve in a closed condition following circulation.

Another form of the invention is shown in FIGS. 4 through 6 which is a casing operated circulation valve 100, i.e., the valve is operated by pressure in the annulus between the string of tubing and a casing. FIG. 4 shows the valve 100 in an initial "going-in" position. A mandrel assembly 102 includes an upper head member 104 which is threadedly connected to a tubular mandrel 106 and forms an internal downwardly facing surface 108. The mandrel 106 is connected at its lower end to a lower head member 110 and forms an internal upwardly facing surface 112. An internal annular recess 114 is thus formed between the upper and lower head members 104 and 110.

Within the annular recess 114 is a valve sleeve assembly 116 which includes telescopically mounted inner and intermediate sleeve members 118,120. The valve sleeve assembly 116 is shown in an upper position in the mandrel recess 114 in FIG. 4 where the intermediate tubular sleeve 120 member is releasably interconnected by a shear pin 122 to the mandrel 106 and has an internal O-ring seal 124 at its upper end. Between the O-ring seal 124 and the shear pin 122 is an internal annular recess 126 in the sleeve member which receives an annular spring biased locking member.

The inner sleeve member 118 includes a port 130 located between O-ring seals 132,134 on the inner member 118 which initially seal with respect to the outer surface of the intermediate sleeve member. Another O-ring seal 136 on a lower base portion seals off the inner sleeve member 118 with respect to the mandrel 106. The lower base portion is shear pinned to the mandrel member 106 by a shear pin 140. In the position of the valve shown in FIG. 4 of the drawings, a circulation port 142 in the mandrel 106 is closed off by the upper and lower seals 108,134 and 136.

When a pressure is applied or increased in the annulus between the string of tubing and the casing relative to the pressure within the bore of the string tubing, an expansion chamber 146 formed in the inner sleeve member 118 has a differential pressure area so that the pressure can be increased and the shear pin 140 can be sheared upon reaching its shear limits. Upon shearing of the shear pin 140, the inner sleeve member 118 is moved axially downwardly relative to the mandrel member 106 to place the circulation port 130 in the inner sleeve member 118 in fluid communication with the circulation port 142 in the mandrel member 106 so that fluid circulation can be accomplished from the exterior of the string of tubing through the interior of the string of tubing. (See FIG. 5). The intermediate sleeve member 120 remains in its initial upper position because of its engagement with the downwardly facing shoulder of the upper head member 104 and because of the shear pin 122.

When the circulation operation is completed, a conventional check valve and plug 160 as shown in FIG. 6 is pumped down the string of tubing to engage an upwardly facing shoulder 162 on the inner sleeve member 118. The check valve 160 includes a tubular body 164 with ar external sealing member 166 which is sealingly engagables with the bore of the inner sleeve member 118 when the valve 160 is seated on the upwardly facing shoulder 162 in the inner sleeve member 118. In the bore of the tubular body 164 is a ball member 168 which engages and seals on an upwardly facing ball seat 170 when pressure is applied to the string of tubing above the ball member 168. Above the ball member 168 is a bypass port 172 which permits liquid to flow in a one way and upward direction through the check valve 160 when the pressure below the ball member 168 is greater than the pressure in the string of tubing above the ball member 168. When the valve and plug 160 are seated in the inner sleeve, pressure in the liquid from a location in the string of tubing above the check valve 160 is cut off from the circulation port 130. However, an increase in pressure above valve 160 is then applied in the bore of the string of tubing above the valve 160 to act on the effective pressure area on the intermediate sleeve member 120 so that pressure applied to the effective cross-sectional area of the intermediate sleeve member 120 and causes the shear pin 122 to shear when the shear limits are reached. Upon shearing of the pin 122, the intermediate sleeve member 120 moves downwardly between the inner sleeve member 118 and the mandrel 106 to close off the mandrel circulation port 142. (See FIG. 6). In the lower position of the intermediate sleeve member 120, the locking member 175 in the groove 126 in intermediate sleeve member engages an annular groove 174 in the mandrel 106 to lock the intermediate sleeve member 120 in a lower position there the circulation ports 142 are closed off from the bore of the string of tubing.

Figure 7:
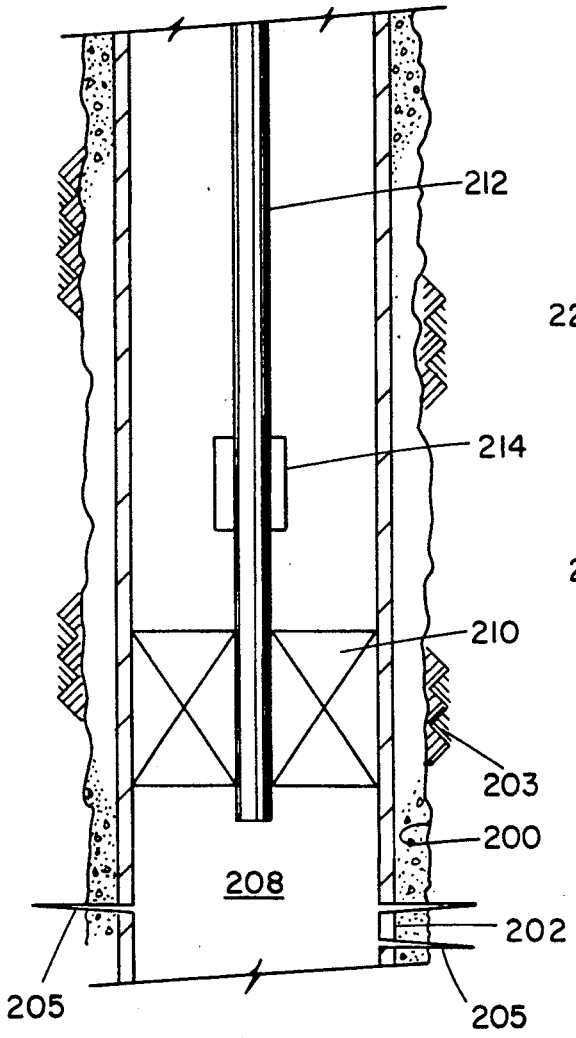
FIG. 7 is a schematic representation of use of a circulatory valves in a single completion process.

Referring now to FIG. 7, a well bore 200 traverses earth formations 201 and is lined with a string of pipe 202 which is either a casing or a liner cemented in place by an annulus of cement material 203. A production zone contains perforations 205 where fluids from a hydrocarbon producible formation can be produced into the bore of the casing 202 when the pressure in the bore of the casing is less than the pressure of the producible hydrocarbons. A weighted control fluid 208 such as mud is disposed in the casing 202 to provide a pressure within the casing greater than the pressure in the formations until production is desired. A single packer 210 is illustrated in FIG. 7 which can be located in the casing by wireline or tubing. In any event, to produce the well, a string of tubing 212 with a circulating valve 214 as described before is connected to the packer 210. With a valve such as described with respect to FIGS. 1–3, a first ball member 80 is dropped or pumped through the string of tubing 212 to seat on the lower valve member 74. The internal pressure is then increased to shift the first sleeve member 18 and open the circulation ports 42 so that fluid (mud) can be circulated from the string of tubing and upwardly through the annulus to the earth's surface. At the completion of the circulation operation, a second ball member 84 is passed through the string of tubing to seat on the valve seat of the member 24. When this occurs, the pressure in the string of tubing can be increased to shift the second sleeve member 16 to the position shown in FIG. 3 where the circulation ports are closed.

By further increasing the pressure the shear pins 72 and 76 can be sheared and the ball members 80,84 and the sleeves 70,74 are discharged through the end of the string of tubing into the casing so that the bore of the string of tubing is full opening.

If the circulating valve 214 is of the type described with respect to FIGS. 4–6, then pressure in the annulus above the packer would be increased to open the circulation ports 142 and circulate the fluid from the annulus through the bore of the string of tubing to the earth's surface. After circulating the liquid, the plug 160 is passed through the string of tubing to close off the bore of the tubing string so that the circulation valve can be closed by increased pressure in the string of tubing. The valve 160 can be removed with a wire line grapple or lift in place as a standing valve, if desired.

Figure 8:
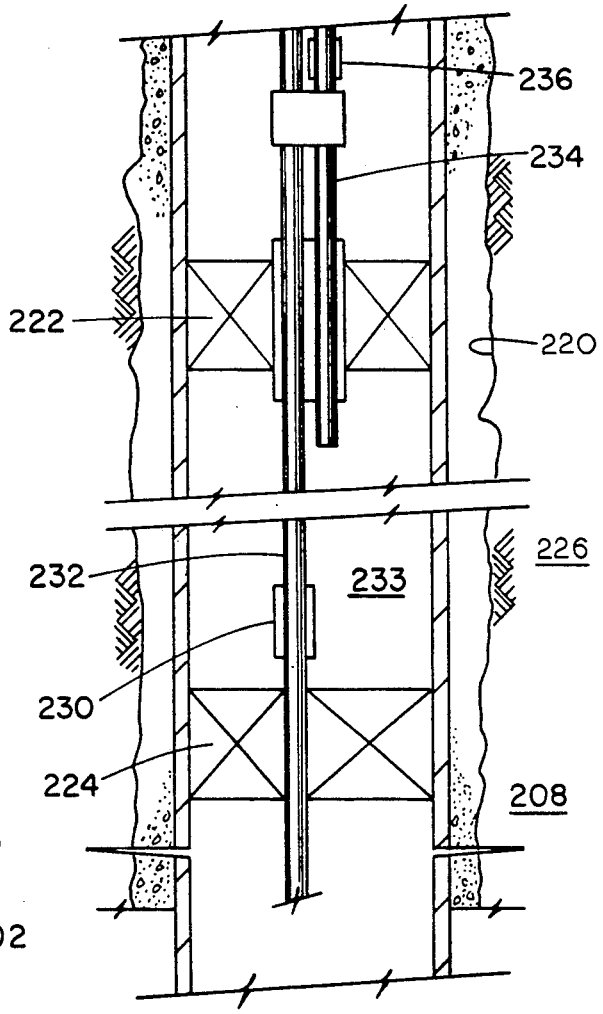
FIG. 8 is a schematic representation of use of circulatory valves in a dual completion.

Referring now to FIG. 8, a dual completion set-up is illustrated in a well bore 220. The dual completion includes upper and lower packers 222,224 which straddle an upper production strata 226 where the lower packer 224 is above a lower production zone. A circulation valve 230 in the long string of tubing 232 can be used to circulate liquid from the volumetric space 233 between the packets 222,224 via the short string of tubing 234. After circulating the liquid from the space 233, a retrievable plug (not shown) can be installed in the tubing string 234 below the circulating valve 236 in the short string of tubing. The circulation valve 236 can then be used to circulate fluid from the space above the packer 222.

In another type of use the short string of tubing 234 can be run in with a retrievable plug below the circulating valve 236 so that circulation can be accomplished above the retrievable plug.

It will be apparent to those skilled in the art that various changes may be made in the invention without departing from the spirit and scope thereof and therefore the invention is not limited by that which is enclosed in the drawings and specifications, but only as indicated in the appended claims.

I claim:

1. A circulating valve for use in a tubing string in a well bore traversing earth formations where the annulus between the tubing string and the well bore contains a liquid, said circulating valve including a tubular mandrel assembly having an annular recess;

a tubular sleeve assembly slidably mounted in said annular recess, said sleeve assembly including first and second sleeve member;

a circulating port in said tubular mandrel assembly intermediate of the length of said annular recess;

said sleeve members having overlapped portions and seal means cooperating with said sleeve member and said mandrel assembly for defining an annular chamber in fluid communication with said circulating port in a first position on said mandrel assembly, said sleeve members being independently movable longitudinally of said mandrel assembly;

first and second release means for respectively releasably connecting said first sleeve member and said second sleeve member to said tubular assembly and for releasably maintaining said annular chamber in fluid communication with said port in said first position;

one of said sleeve members being responsive to a pressure applied in said annular chamber for releasing one of said first and second releasable means so that said one sleeve member moves longitudinally to a second position for placing the interior of said tubular mandrel assembly in fluid communication through said port with the exterior about said sleeve members;

means forming an effective pressure area on said one sleeve member and including a tubular valve seat located in the one sleeve member below said circulating port in said second position of said one sleeve member and where said valve seat and said one member are adapted to receive a sealing member so that said other sleeve member can be moved longitudinally in response to pressure to said second position for closing said circulation port; and means cooperating with said other of said first and second sleeve members and said tubular assembly for locking said other sleeve member in said second position.

2. The apparatus as set forth in claim 1 wherein said sleeve members are normally in an upper location in said annular recess and said one sleeve member has a sleeve member port along its length so that when said one sleeve member moves longitudinally to said second position said sleeve member port in said one sleeve member aligns with the port in said tubular assembly, said one sleeve member being arranged to abut the lower end of the annular recess in said second position.

3. A circulating valve for use in a tubing string in a well bore traversing earth formations where the annulus between the tubing string and the well bore contains a liquid, said circulating valve including, a tubular mandrel having an annular recess defined by upper and lower end surfaces;

an upper port in said mandrel adjacent to said upper end surface, a lower port in said mandrel adjacent to said lower end surface and a circulation port in said mandrel intermediate of said upper and lower ports., first and second sleeve members disposed in said annular recess and having overlapped portions, first seal means for sealing off said first sleeve member with respect to said upper port;

second seal means for sealing off said overlapped portions and said second sleeve member with respect to said circulation port;

third seal means for sealing off said second sleeve member with respect to said lower port;

said first sleeve member having equal effective pressure areas between said upper port and said circulation port;

said second sleeve member having equal effective pressure areas between said circulation port and said lower port;

first releasable means for releasably connecting said first sleeve member to said tubular mandrel;

second releasable means for releasably connecting said second sleeve member to said tubular mandrel;

first tubular seat means releasably connected in said mandrel between said upper port and said circulating port;

second tubular seat means releasably connected in said mandrel between said circulating port and said lower port;

said first seat means having a larger bore than the bore of the second seat means so that said first seat means can receive a first sealing member and thereby permit fluid pressure to be applied through said circulatory port to said second sleeve member and release said second releasable means to shift said second sleeve member to a location to disconnect said overlapped portions;

said second seat means being sized to receive a second sealing member and thereby permit fluid pressure to be applied through said upper port and release said first releasable means to shift said first sleeve member toward said second sleeve member and rejoin said overlapped portions.

4. The apparatus as set forth in claim 3 and further including locking means for retaining said first sleeve member in position after the overlapper portions are rejoined.

5. A method of circulating liquids relative to a string of tubing in a liquid filled well bore including the steps of:

disposing a string of tubing in a liquid filled well bore with a circulating valve near the lower end of said string of tubing where the circulating valve has upper and lower longitudinally movable sleeve members on a tubular mandrel and where such sleeve members have overlapping portions for closing off a circulation port in the tubular mandrel and are respectively releasably connected to the tubular mandrel;

closing off the bore of said string of tubing at a location below said circulation port and developing a pressure differential between the interior of the string of tubing and the well bore across the lower sleeve member for releasing such lower sleeve member from the tubular member and for opening said circulating port by longitudinally moving said lower sleeve member;

closing off the bore of the upper sleeve member at a location above said circulation port and applying pressure to liquid within the string of tubing above the upper member for releasing such upper member from the tubular member and for reclosing said circulation port by longitudinally moving said upper sleeve member; and retaining both of the sleeve members in the reclosing position of the sleeve members.

6. A method of circulating liquids relative to a string of tubing in a liquid filled well bore including the steps of:

disposing a string of tubing in a liquid filled well bore with a circulating valve near the lower end of said string of tubing where the circulating valve has first and second longitudinally movable sleeve members telescopically disposed in a recess in a tubular mandrel and where such sleeve members have overlapping portions for closing off a circulation port in the tubular mandrel and are respectively releasably connected to the tubular mandrel;

developing a pressure differential between the exterior and the interior of the string of tubing across one of the sleeve members for releasing such one sleeve member from the tubular member for longitudinal movement and for opening said circulating port;

closing off the bore of said one sleeve member and said circulation port for applying pressure to liquid within the string of tubing to the other sleeve member for releasing such other sleeve member from the tubular member and for longitudinal movement and for closing off said circulation port; and retaining both of the sleeve members after longitudinal movement in the position closing off the circulation port.

* * * * *